US007318443B1

(12) United States Patent
Ma

(10) Patent No.: US 7,318,443 B1
(45) Date of Patent: Jan. 15, 2008

(54) PAGODA-SHAPED UMBRELLA

(76) Inventor: Joen-Shen Ma, 12F, No. 578, Kwang Fu South Rd., Taipei (TW)

( * ) Notice: Subject to any disclaimer, the term of this patent is extended or adjusted under 35 U.S.C. 154(b) by 0 days.

(21) Appl. No.: 11/450,283

(22) Filed: Jun. 12, 2006

(51) Int. Cl.
*A45B 25/14* (2006.01)

(52) U.S. Cl. ..... 135/28; 135/25.33; 135/20.3

(58) Field of Classification Search ..... 135/98, 135/20.3, 25.33, 28, 39, 33.2
See application file for complete search history.

(56) References Cited

U.S. PATENT DOCUMENTS 3,870,062 A * 3/1975 Medlin ..... 135/20.3
4,038,997 A * 8/1977 Smith ..... 135/114
5,329,953 A * 7/1994 Becher ..... 135/31
5,386,842 A * 2/1995 Becher ..... 135/20.3
5,444,943 A * 8/1995 Schelfhorst ..... 52/63
5,482,069 A * 1/1996 Lee ..... 135/31
5,711,333 A * 1/1998 Vanderminden, Sr. ..... 135/20.3
5,901,722 A * 5/1999 Lee ..... 135/25.1
6,543,464 B1 * 4/2003 Grady, II ..... 135/22
2004/0040591 A1 * 3/2004 Ma ..... 135/908
2005/0045219 A1 * 3/2005 Apple ..... 135/31

* cited by examiner

*Primary Examiner*—Winnie Yip
(74) *Attorney, Agent, or Firm*—Rosenberg, Klein & Lee

(57) ABSTRACT

A pagoda-shaped umbrella includes a center post, a crown fixed to an upper end of the center post, a runner movable along the center post, a plurality of ribs each coupled to the runner by a stretcher, and a canopy supported by the ribs. A canopy retainer is mounted to the canopy to move to the topmost position when the canopy is open. A collar movably fits over the center post between the runner and the crown and a pair of slide bars extending from the collar, along opposite sides of the center post and movably through openings defined in the crown. Upper ends of the bars are fixed to the canopy retainer. When the runner is moved upward to drive the stretchers and the ribs for opening the canopy, the runner gets into contact with and thus drives the collar upward, which in turn causes upward movement of the retainer to the topmost position thereby shaping the canopy as a pagoda.

1 Claim, 5 Drawing Sheets

PAGODA-SHAPED UMBRELLA

BACKGROUND OF THE INVENTION

1. Field of the Invention

The present invention generally relates to a pagoda-shaped umbrella having a contractible topmost extension of a center post to shape a canopy of the umbrella as a pagoda, and in particular to a pagoda-shaped umbrella having bars axially extendible from the top end of the center post to form a tee of the pagoda with a simple mechanism.

2. The Related Art

A conventional pagoda-shaped umbrella, as illustrated in FIG. 5 of the attached drawings, comprises an upright center post 30 having a lower supported on a base (not labeled) and an upper end to which a crown 32 is attached, a runner 31 movable along the center post 30, a plurality of ribs 33 pivoted to and radially extending from the crown 32 and stretchers 34 coupled between the ribs 33 and the runners 31 whereby when the runner 31 is moved toward the crown 32, the ribs 33 are driven upward by the stretchers 34 to open a canopy 35 mounted to the ribs 33. An axle 38 coaxially and telescopically extends from the upper end of the center post 30 and forms a top canopy retainer 36 at an upper end thereof. A helical spring 37 encompasses the axle 38 and is retained between the canopy retainer 36 and the crown 32 to bias the retainer 36 upward and away from the crown 32 to form a tee of a pagoda. When the umbrella is opened by moving the runner 31 toward the crown 32, the particularly configured canopy 35, under the action of the spring force of the spring 37, allows the axle 38 to move upward and thus making the retainer 36 away from the crown 32 to support the canopy 35 as a tee of a pagoda.

The conventional device that makes use of the spring force to support the retainer 36 at a distant position suffers fatigue of the spring 37, which reduces the spring force to expand the canopy to form the pagoda shape. Thus, the overall configuration of the canopy, after being expanded by the reduced spring force, is no longer maintained as a pagoda. The service life of the umbrella is thus shortened. In addition, the axle 38 is a must for properly supporting the spring 37 in position. The axle 38 must extend through the crown 32 in a telescopic and coaxial manner. This complicates the manufacturing process and the increases costs.

Thus, the present invention is aimed to solve the problems of the conventional pagoda-shaped umbrellas.

SUMMARY OF THE INVENTION

An objective of the present invention is to provide a pagoda-shaped umbrella comprising a collar and slide bar assembly that forms a tee of a pagoda after the umbrella is opened, which collar and slide bar assembly has a simple construction and low costs.

To achieve the above objective, in accordance with the present invention, a pagoda-shaped umbrella comprises an umbrella frame comprised of a center post, a runner, a crown, a plurality of ribs each supported by a stretcher to support a canopy. The crown is mounted to an upper end of the center post. The runner is movable along the center post and is coupled to the ribs by the stretchers to open and close the canopy that is supported by the ribs. A canopy retainer is arranged at a center of the canopy and is movable to a topmost position when the umbrella is opened. A collar is movably fit over the center post between the crown and the runner. A pair of slide bars extends along opposite sides of the center post and movably through openings defined in the crown. Lower ends of the slide bars are fixed to the collar and upper ends of the slide bars are fixed to the canopy retainer that is located at the center of the canopy. The movable extension of the slide bars through the crown allows the distance between the canopy retainer and the retainer to be variable. When the collar moves along the center post, the slide bar drives the canopy retainer to move in unison with the collar. By moving the runner along the center post to open the canopy through the coupling of the ribs and the stretchers, the collar is also moved by the runner and thus the canopy retainer upward to the topmost position to form the pagoda tee.

When the runner is moved downward to close the canopy, the collar and the retainer are allowed to move downward until the retainer gets into contact with the crown. This effectively shortens the overall length of the collapsed umbrella.

By means of the assembly of the collar and the slide bars, the movement of the canopy retainer that is fixed to the canopy can be easily effected without any resilient element or spring that is conventionally required. Thus, fatigue of resiliency is completely eliminated. Further, due to the simple construction of the collar and slide bars, the manufacturing process of the pagoda-shaped umbrella is simplified and manufacturing costs are reduced. Such a simple construction is also effective in reducing the chance of malfunction or breakdown, which in turn extends the service life of the umbrella. The overall length of the umbrella after collapse of the umbrella is shortened, which is advantageous in packaging, transportation and storage of the umbrella.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
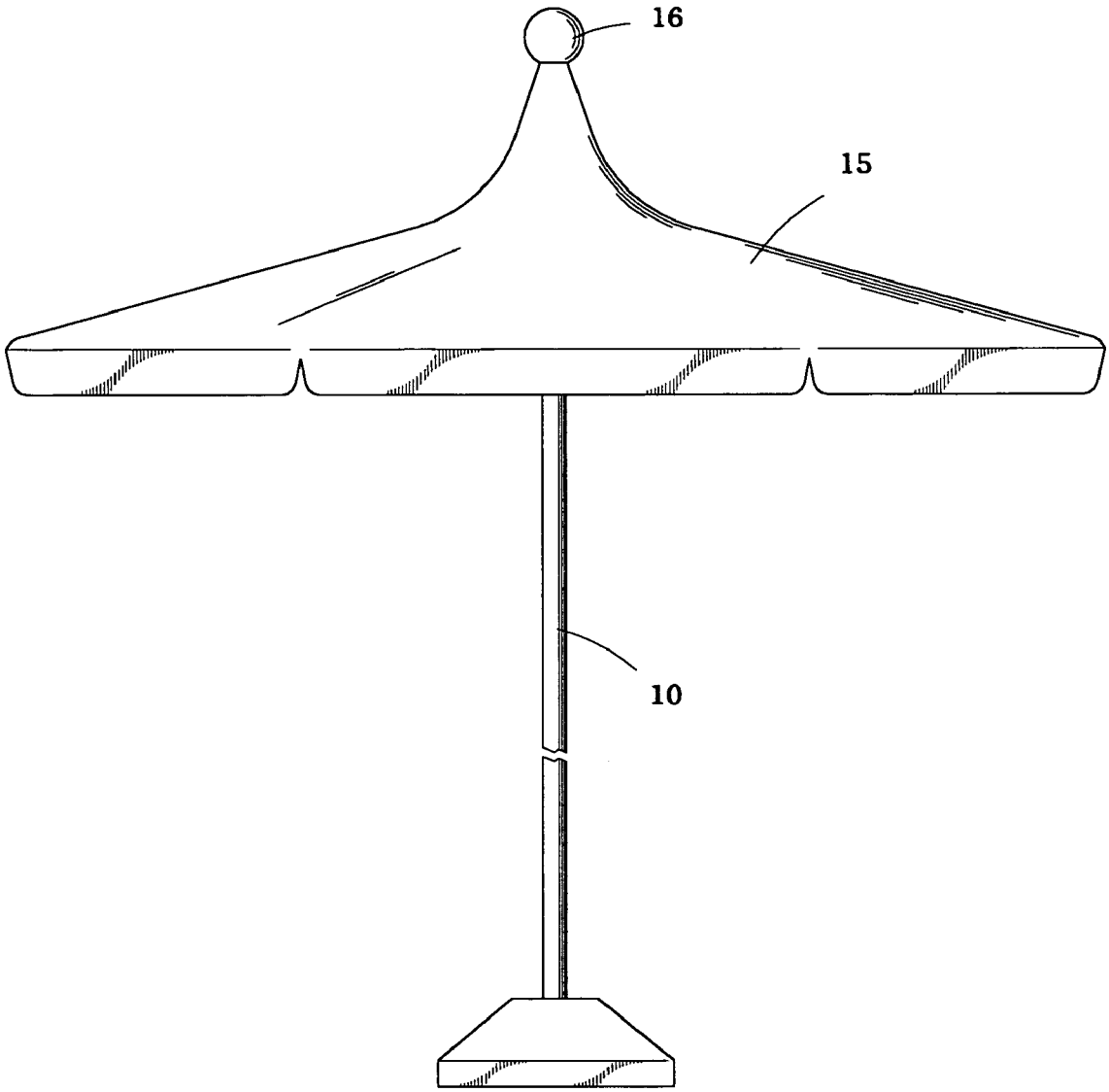
FIG. 1 is a side elevational view of a pagoda-shaped umbrella constructed in accordance with the present invention in an open condition.
Figure 2:
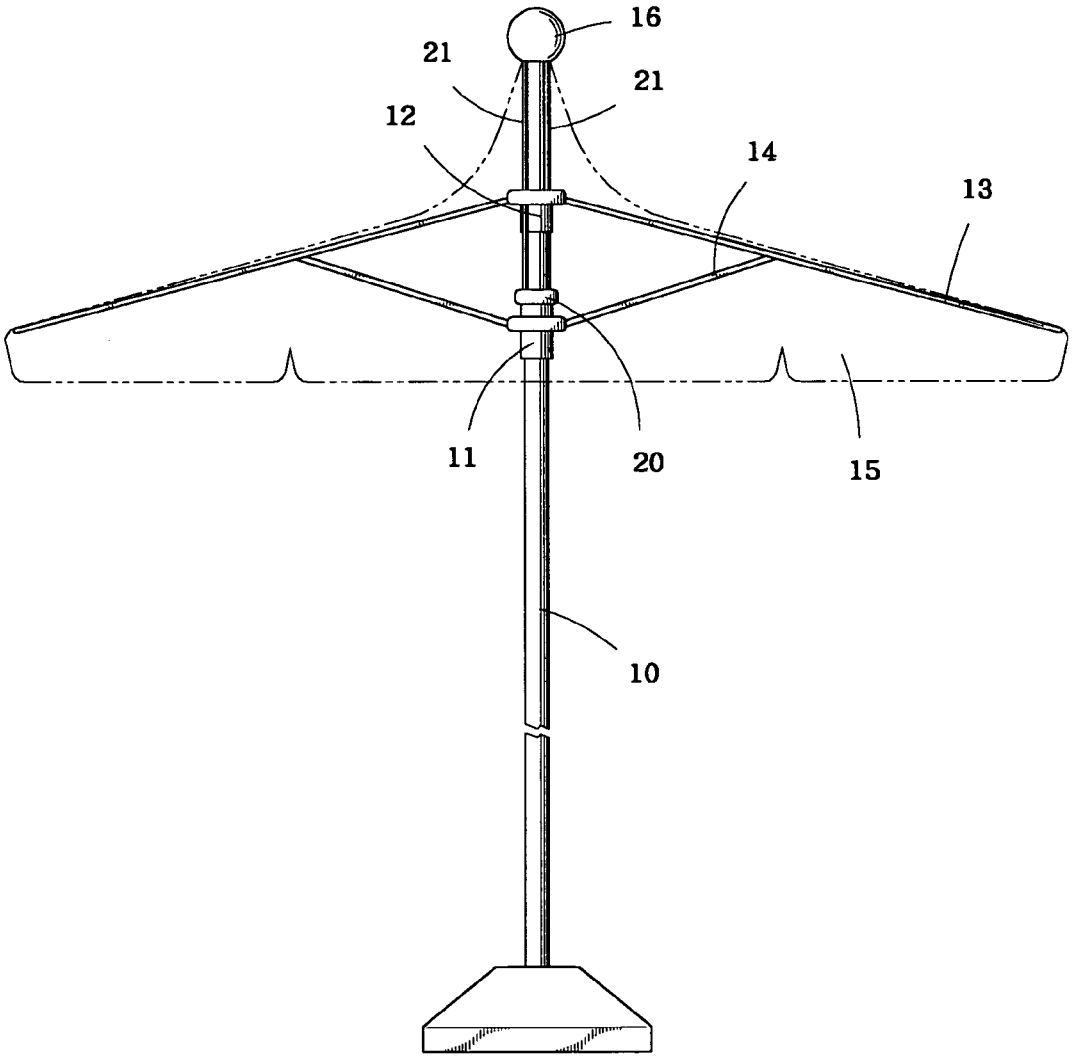
FIG. 2 is similar to FIG. 1 but with a canopy removed to illustrate inside details of the umbrella of the present invention.
Figure 3:
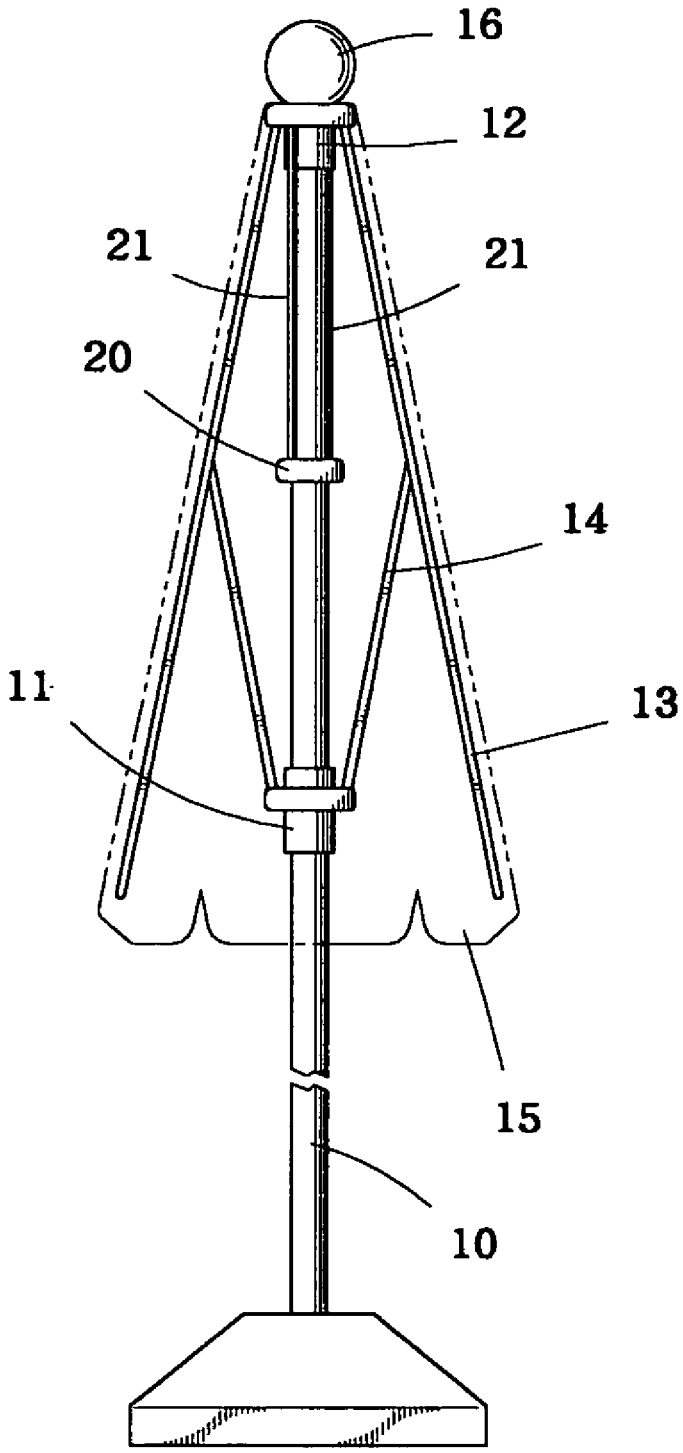
FIG. 3 is a side elevational view showing the collapse of the umbrella of the present invention, with the canopy removed.

With reference to the drawings and in particular to FIGS. 1 and 2, which are side elevational views of a pagoda-shaped umbrella constructed in accordance with the present invention, respectively showing a canopy attached to and removed from a frame of the umbrella in an open condition, and FIG. 3, which shows the umbrella in a closed condition, the umbrella constructed in accordance with the present invention comprises a center post 10, a runner 11, a crown 12, a plurality of ribs 13 each associated with a stretcher 14, and a canopy 15.

The crown 12 is fixed to an upper end of the center post 10. The runner 11 is movable along the center post 10. Each rib 13 is coupled to the runner 11 by the associated stretcher 14 to open/close the canopy 15, which is supported by the ribs 13, with the movement of the runner 11 along the post 10 in upward/downward direction.

A canopy retainer 16 is arranged at and fixed to a center of the canopy 15. When the umbrella is open or expanded, the retainer 16 is located at a topmost position of the umbrella in a regular application, as shown in FIGS. 1 and 2.

Figure 4:
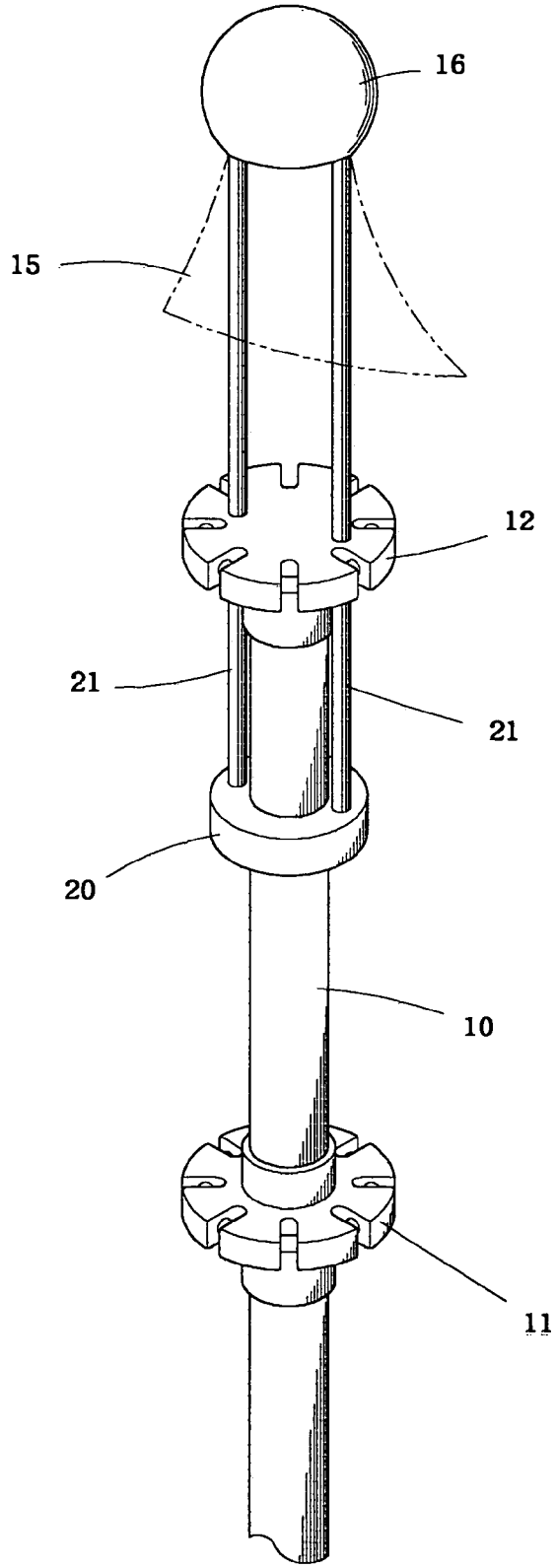
FIG. 4 is a perspective view of a collar and slide bar assembly of the pagoda-shaped umbrella of the present invention.
Figure 5:
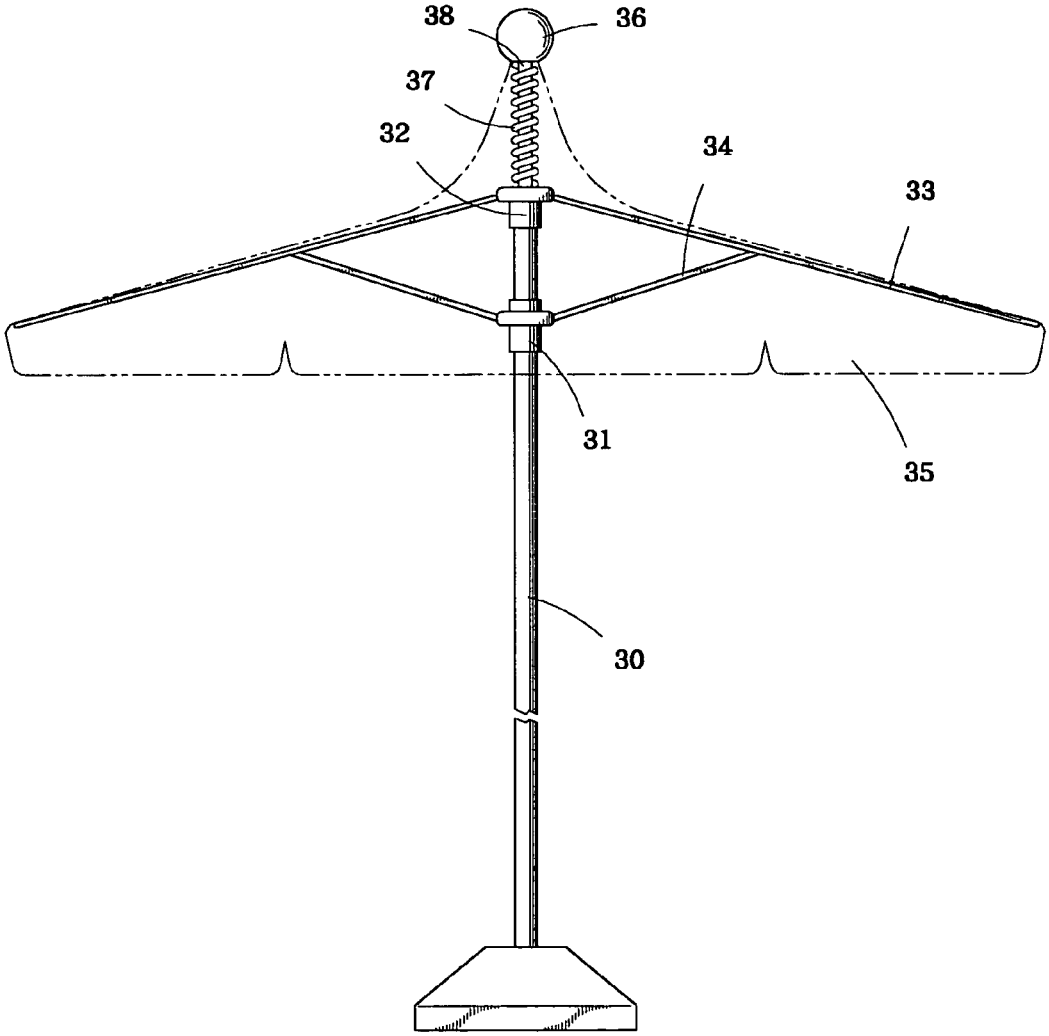
FIG. 5 is a side elevational view of a conventional pagoda-shaped umbrella with a canopy removed.

A collar 20 is movably fit over the center post 10 between the crown 12 and the runner 11, as best seen in FIG. 4. A pair of slide bars 21 is arranged on opposite sides of and extends along the center post 10. The slide bars 21 have lower ends fixed to the collar 20 and upper ends movably extending through openings (not labeled) defined in the crown 12 and fixed to the retainer 16.

The movable extension of the slide bars 21 through the crown 12 makes a variable distance between the crown 12 and the retainer 16, as shown in FIG. 4. When the collar 20 moves along the center post 10, the slide bars 21 moves with respect to the crown 12, which causes displacement of the retainer 16 with respect to the crown 12 thereby changing the distance therebetween.

As shown in FIG. 2, when the runner 11 is driven upward along the center post 10, the ribs 13 are forced upward by the stretchers 14 thereby opening the canopy 15. The upward movement of the runner 11 brings the runner 11 into contact with the collar 20 and then causes the collar 20 to move upward with the runner 11. The movement of the collar 20 is transmitted to the retainer 16 by the slide bars 21, thereby driving the retainer 16 away from the crown 12 to the topmost position, showing an upward-projecting tee of a pagoda.

As shown in FIG. 3, when the runner 11 is moved downward along the center post 10, the canopy 15 collapses. At the same time, the collar 20 and the slide bars 21 are allowed to move downward, which brings the retainer 16 toward and eventually getting into contact with the crown 12. The overall length of the umbrella in the collapsed condition is thus shortened.

The umbrella described above is simple in construction, easy to assemble, and durable for long term use. The overall length of the umbrella after collapse is shortened, which facilitates packaging, transportation, and storage.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A pagoda umbrella comprising:

a center post;

a crown fixed to an upper end of the center post;

a runner movable along the center post;

a plurality of ribs;

a stretcher coupling each rib to the runner;

a canopy supported by the ribs whereby when the runner moves along the center post, the ribs are driven by the stretchers to open/close the canopy;

a canopy retainer mounted to the canopy and movable to a topmost position of the umbrella when the canopy is open, said crown and said canopy retainer being coupled to the other to provide a fixed distance therebetween;

a collar movably mounted over the center post located between the runner and the crown and;

a pair of slide bars extending along opposite sides of the center post and movably extending through the crown, the slide bars having lower ends fixed to the collar and upper ends fixed to the canopy retainer, wherein when the runner is moved upward, said rib and stretchers are actuated to open the canopy, the runner further engages and drives the collar upward thereby moving the slide bars and the canopy retainer upward to position the canopy retainer at the topmost position and whereby said canopy is shaped into the contour of a pagoda.

* * * * *